United States Patent [19]

Eckart

[11] Patent Number: 4,958,358

[45] Date of Patent: Sep. 18, 1990

[54] APPARATUS FOR THE THERMAL TREATMENT OF A METALLIC MELT

[75] Inventor: Schunk Eckart, Düsseldorf, Fed. Rep. of Germany

[73] Assignee: Mannesmann Aktiengesellschaft, Düsseldorf, Fed. Rep. of Germany

[21] Appl. No.: 352,934

[22] Filed: May 17, 1989

[30] Foreign Application Priority Data

May 18, 1988 [DE] Fed. Rep. of Germany ..... 3817379

[51] Int. Cl.[5] ..... H05B 7/00

[52] U.S. Cl. ..... 373/72

[58] Field of Search ..... 373/72, 108, 75

[56] References Cited

U.S. PATENT DOCUMENTS 4,843,614 6/1989 Guido ..... 373/108

*Primary Examiner*—Roy N. Envall, Jr.

*Attorney, Agent, or Firm*—Cohen, Pontani & Lieberman

[57] ABSTRACT

Apparatus for the thermal treatment of a metallic melt includes a metallurgical vessel (10) for receiving the melt; a D.C. arc heating device for heating the melt includes at least one electrode (20) positioned above the melt and at least one counterelectrode (22) in contact with the melt; a first element located on the outer jacket of the metallurgical vessel for transferring electrical energy to the counterelectrode; a second element (40) for transferring electrical energy to the first transfer element (30); and a compensation or equalizing element (45, 44) operatively connected to the second transfer element for mechanically positioning the contact plane of the second transfer element in electrical energy conducting relation with the contact plane of the first transfer element.

20 Claims, 5 Drawing Sheets

APPARATUS FOR THE THERMAL TREATMENT OF A METALLIC MELT

FIELD OF THE INVENTION

The present invention relates to an apparatus for the thermal treatment of a metallic melt, including a metallurgical vessel for receiving the melt and a D.C. arc heating device which operates separately or as a integral part thereof and which has at least one electrode arranged above the melt and at least one counter-electrode in contact with the melt.

BACKGROUND AND SUMMARY OF THE INVENTION

An arrangement for direct current with contacts for a bottom electrode in the vicinity of the ladle bottom is known from German Unexamined Application for Patent OS 31 07 454. The object of this invention is to eliminate the space problem in ladles and ladle furnaces. It does not concern itself with solving the problem of the feeding of energy to the bottom electrodes.

A terminal for detachably connecting electric-current and coolant transfer is known from German Unexamined Application for Patent OS 35 35 690. The connection can be a screw, wedge or clamp connection. When changing the contact electrode, the contact points on the terminal are detached by the operating personnel in order to separate the electric cable and the coolant conduits from the contact electrode. The attaching or detaching of the contact electrode is thus subject to the disadvantage that the operating personnel must work under difficult ergonomic conditions.

One of the objects of the present invention is to create a maintenance-free and easily interchangeable apparatus which renders it possible to connect the counter-electrode automatically and reliably to the power line leading to the energy source.

To achieve this object there is provided an apparatus for the thermal treatment of a metallic melt comprising a metallurgical vessel for receiving the melt, the vessel having an outer jacket; means for electrically heating the melt comprising at least one electrode positioned above the melt and at least one counterelectrode in contact with the melt; first means on the outer jacket and connected to the counterelectrode for transferring electrical energy to the counterelectrode, the transfer means comprising a first contact plane; second means for transferring electrical energy to the first transfer means, the second transfer means comprising a second contact plane; and means operatively connected to the second transfer means for mechanically positioning the contact plane of said second transfer means in electrical energy conducting relation with the contact plane of the first transfer means. Preferably, the means for electrically heating the melt comprises a D.C. arc heating device.

In accordance with the invention, and upon depositing the metallurgical vessels such as ladles or distributors at the respective processing station, the electric contact with the bottom electrode is produced without any activity on the part of the operating personnel.

The contact planes or surfaces which are connected to the source of energy are provided at the processing stations such as, for example, at the vacuum unit, at a rotary tower or on the premises of the foundry which can be reached by a plant vehicle. These contact surfaces or planes can be brought, with respect to their vertical and horizontal arrangement at the processing station, in contact with respective surfaces of current feed elements for the bottom electrode attached to the vessel. A dimension which must be taken into consideration in this connection the feet or the support elements of the vessel such as, for instance, suspension loops or carrying claws as well as the distance from a vessel wall.

The contact surfaces are preferably arranged in the vicinity of the bottom of the metallurgical vessel. A particularly suitable location for the transfer elements is the outer jacket of the metallurgical vessel since matching support elements can be provided at the various processing stations, such as the rotary tower or the vacuum unit, and the mounting thereof can be assured more easily there.

The respective contact surfaces have a size which assures dependable transmission of energy. Several contacts can also be attached on the circumference of the vessels.

Graphite is provided as contact material, it being mechanically wear-resistant as well as resistant to pressure and temperature and it has the capacity to transmit electrical energy with low losses. The contact elements are made readily exchangeable for easy maintenance.

Possible accumulation of dirt is counteracted by specially designing the contact surface as described herein. Accordingly, the support surface of at least one of the elements for the transmission of energy is preferably divided into individual segments. A maximal snug-fit effect can be achieved for the outer contact surfaces by developing the surface segments from individual graphite bodies which can compensate for small changes of movement thereof in the direction of the contact pressure.

In another advantageous development of the invention the counterelement is developed as a pocket which is filled with graphite powder. In this way a close contact between the contacting surfaces is achieved.

In order to assure dependable contact of the total contact areas in rough operation the invention provides for a substantially vertical or horizontal compensation. For this purpose the structural parts which are in contact with the source of energy are mounted on springs or else are moveable along their longitudinal axis and in contact with a pressure accumulator. This measure assures constant pressure of the contacts against each other which can furthermore be regulated if necessary. In addition, the contact surfaces are tiltable with respect to the vertical or horizontal plane.

BRIEF DESCRIPTION OF THE DRAWINGS

Various embodiments of the invention are shown in greater detail in the drawings, in which.

DETAILED DESCRIPTION OF THE PRESENTLY PREFERRED EMBODIMENTS

Figure 1:
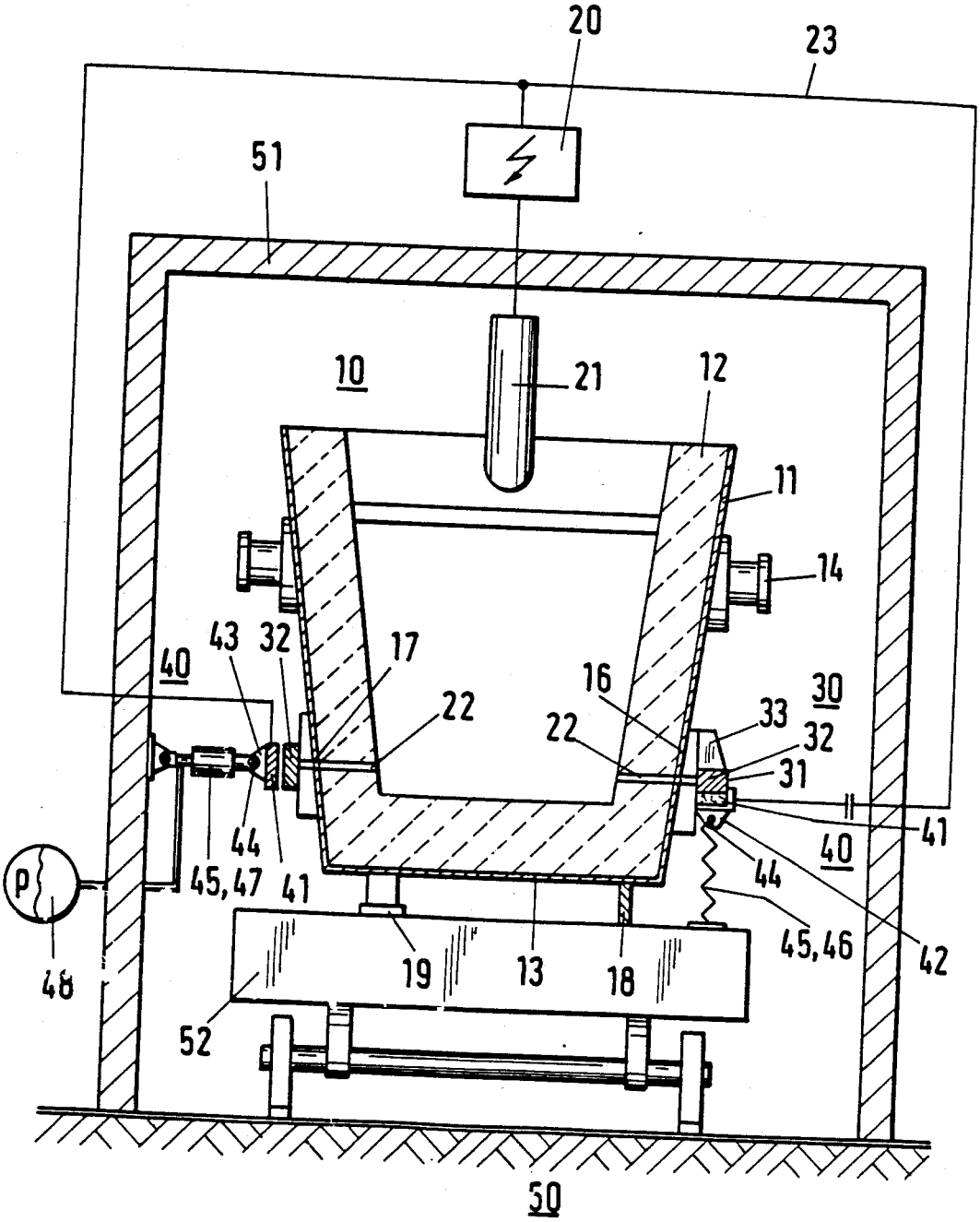
FIGS. 1 and 1(*a*) represent a sectional view through a ladle heating unit.

FIGS. 1 and la show a treatment station 50 having a housing 51 within which the metallurgical vessel 10 is located on a foundry vehicle 52.

Electrical current is fed from a source of electrical energy 20 via current feed lines 23 to electrode 21 and counterelectrodes 22. The counterelectrodes 22 are arranged predominantly in the area of the bottom 13 of the metallurgical vessel 10. The vessel 10 consists of a jacket 11 having a carrying means 14 and a refractory lining 12.

Elements 30 for the transmission of electrical energy are arranged on the jacket 11 by means of a bracket 33.

Each element 30 has a counterelement 40 which is connected to the energy source through current feed line 23 and which is moveable with respect to the element 30 by means of compensating or equalizing elements 45. The compensating element 45 is developed as spring 46 on the right-hand side of FIG. 1, while it is developed mechanically as piston-cylinder unit 47 with pressure accumulator 48 on the left-hand side of the figure.

Figure 1A:
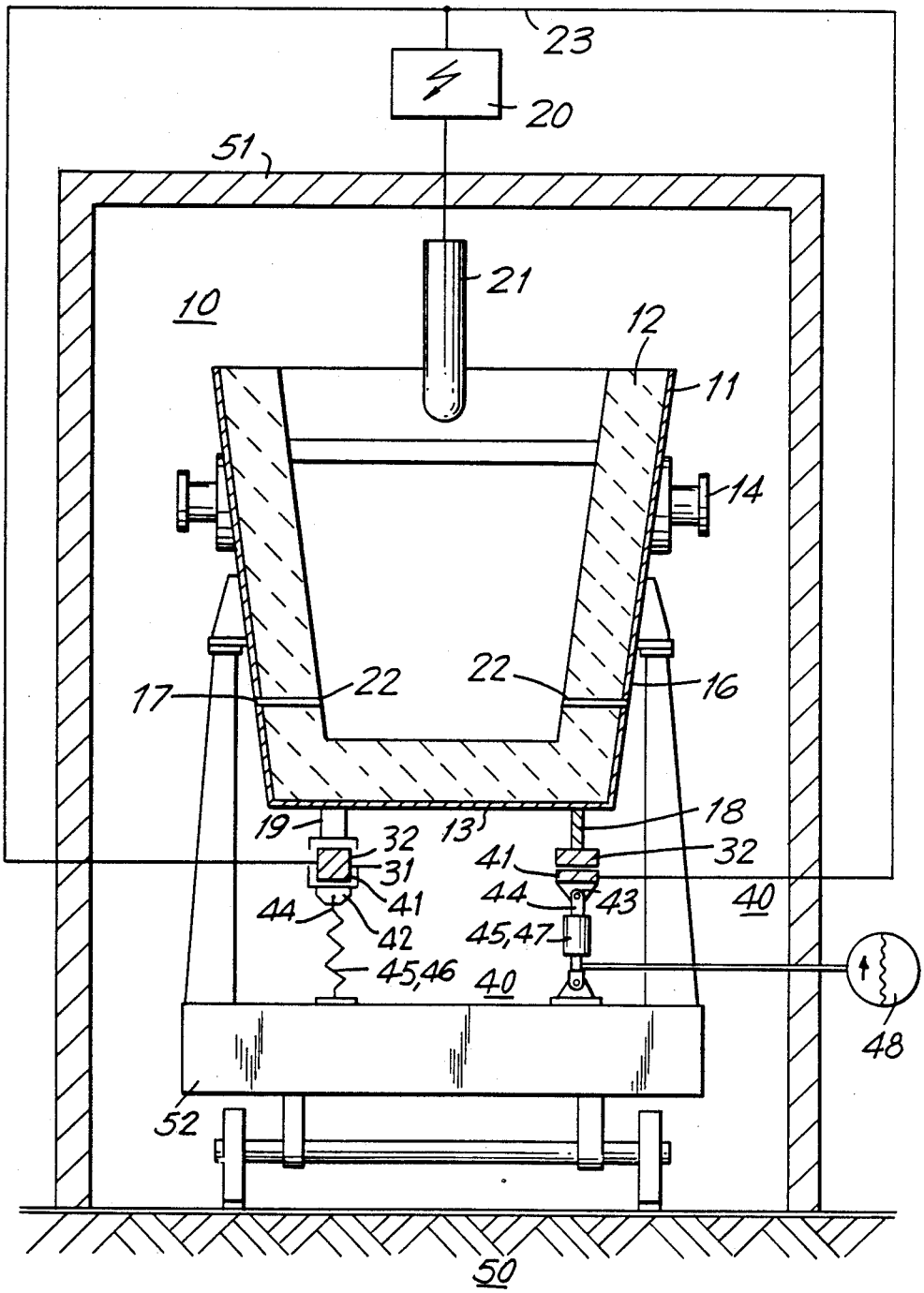

The metallurgical vessel 10 is supported at the bottom either by the supporting ring 18 or feet 19 (see particularly FIG. 1*a*).

Figure 2:
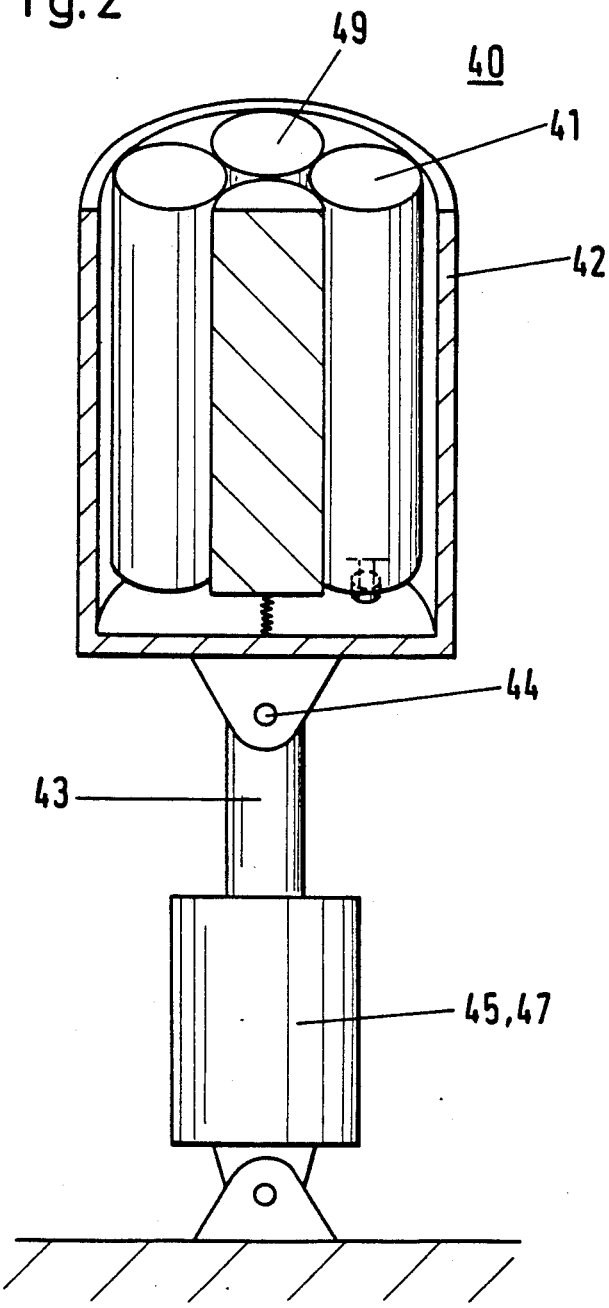
FIG. 2 shows a structural part divided into segments.

FIG. 2 shows the counterelement 40 comprising the structural part 42 for the transfer of energy and a lug having the articulation or pivot 44. The supporting element 43 acts on said articulation 44, and is further connected to the compensating element 45, in this case the piston-cylinder unit 47.

Structural part 42 includes the segments 49, in this case a plurality of cylindrical bodies of graphite representing the surface 41. The surface segments 49 are displaceable in the direction of the contact pressure.

Figure 3:
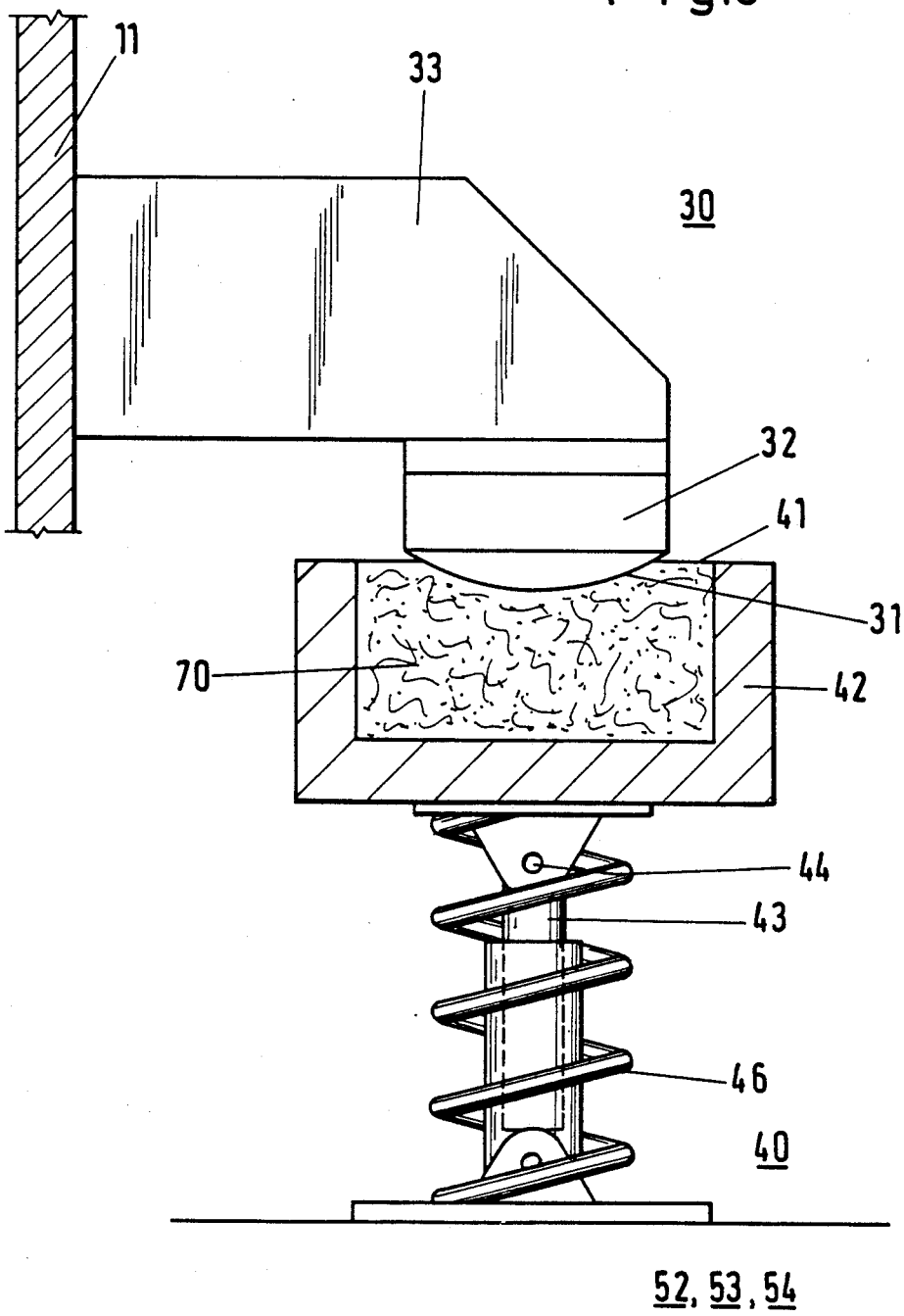
FIG. 3 shows a pocket-shaped structural part.

FIG. 3 shows element 30 for the transmission of electric energy. The structural part 32 for the transmission of energy is, in this case, developed as a plate which, via bracket 33, is attached to the jacket 11 of the metallurgical vessel 10 and for contact with counterelectrode 22 (not shown). The plate 32 has a contact surface or plane 31.

The contact surface or plane 41 of the counterelement 40 applies itself against the contact plane 31. The plane 41 is formed of pulverized graphite 70 which is arranged in the structural part 42 for the transmission of energy, the latter having a lug with the pivot 44. The support element 43 acts on the articulation 44, and is further connected to a foundry vehicle 52, a ladle rotary tower 53 or a distributor trough 54. Co-axial to the support element 43 there is provided a spring 46 by means of which the structural part 42 can be moved in the direction of the element 30 so that the contact surfaces 31 and 41 contact each other.

Figure 4:
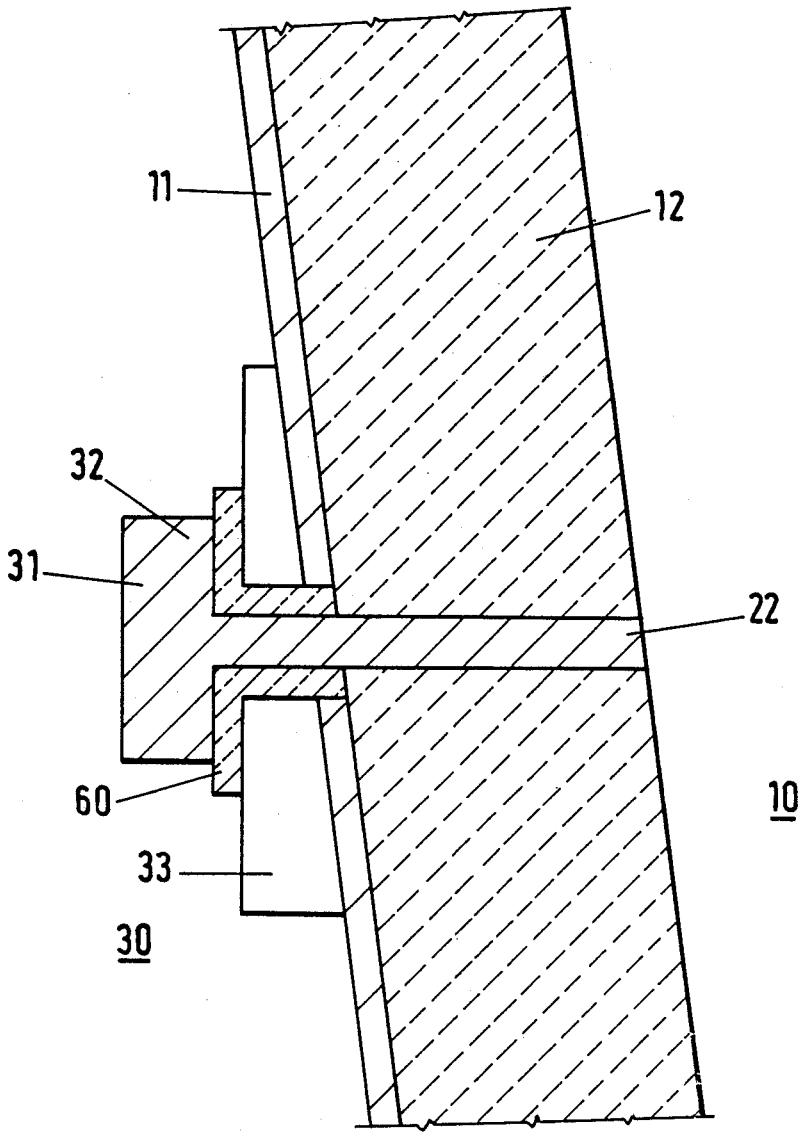
FIG. 4 shows an insulated counterelectrode.

FIG. 4 shows a detail of the metallurgical vessel 10 with its jacket 11 and the refractory lining 12. The bracket 33 is fastened to the jacket 11. A bore through which the counterelectrode 22 is place extends through the bracket, the jacket and the refractory lining. The structural part 32 of the element 30 for the transmission of electric energy is separated from the metallic elements 11 (jacket) and 33 (bracket) by the electrical insulation 60. The counter-element 40, not shown, contacts with its plane 41 against the plane 31 of the structural part 32 for the transmission of energy.

Since these as well as further embodiments and modifications thereto are intended to be within the scope of the present invention, the above description should be construed as illustrative and not in a limiting sense, the scope of the invention being defined by the following claims.

What is claimed is:

1. An apparatus for the thermal treatment of a metallic melt comprising:

a metallurgical vessel (10) for receiving said melt, said vessel having an outer jacket(11);

D.C. arc heating means for heating said melt comprising at least one electrode (21) positioned above said melt and at least one counterelectrode (22) in contact with said melt;

first means (30) on said outer jacket and connected to said counterelectrode for transferring electrical energy to said counterelectrode, said transfer means comprising a first contact plane (31);

second means (40) for directly transferring electrical energy to said first transfer means (30), said second transfer means (40) comprising a support element (43) and detachably mounted thereto a structural part (44) having a second contact plane (41); and means (45,44) operatively connected to said second transfer means for mechanically positioning said contact plane of said second transfer means in electrical energy conducting relation with said contact plane of said first transfer means.

2. The apparatus according to claim 1, wherein said metallurgical vessel additionally comprises a support ring and wherein said first transfer means is located on said support ring.

3. The apparatus according to claim 1, wherein said metallurgical vessel additionally comprises a plurality of feet, and wherein said first transfer means is located on said feet.

4. The apparatus according to any one of claims 1 to 3, wherein said first and second means (30, 40) for the transfer of electrical energy comprise structural parts (32, 42), made of non-combustible, electrically conductive material.

5. The apparatus according to claim 4, wherein said material is graphite.

6. The apparatus according to claim 4, wherein said contact planes (31, 41) of said structural parts (32, 42) are divided into individually spaced segments (39, 49).

7. The apparatus according to claim 6, wherein said individual segments (39, 49), are independently moveable in the direction of contact.

8. The apparatus according to claim 4, wherein said structural part (42) of said second transfer means (40) is formed as a pocket filled with powdered graphite (70).

9. The apparatus according to claim 1, additionally comprising a pivot (44) connected to said support element (43) for permitting angular movement of said second contact plane (41) with respect to the position thereof in un-stressed condition.

10. The apparatus according to claim 10, additionally comprising an equalizing means (45) mounted to said pivot (44) for allowing displacement of said second contact surface (41) in the direction of contact.

11. The apparatus according to claim 10, wherein said equalizing means (45) is a spring (46).

12. The apparatus according to claim 10, wherein said equalizing means (45) is a piston cylinder unit (47).

13. The apparatus according to claim 12, additionally comprising a pressure accumulator (48) connected to said piston cylinder unit (47).

14. The apparatus according to claim 13, wherein said accumulator (48) is regulated as a function of the contact pressure between said first contact plane (31) and said second contact plane (41).

15. The apparatus according to claim 13, wherein said counterelectrode (22) is connected to said structural part (32) of said first transfer means (30).

16. The apparatus according to claim 15, further comprising an electrical insulation (60) between structural part (32) and counterelectrode (22) and said outer jacket (11) of said metallurgical vessel (10).

17. The apparatus according to claim 9, wherein said equalizing means (45) is arranged on a foundry vehicle (52), said vehicle being movable for receiving said metallurgical vessel 910) and comprising means for fixation thereof in a basic position for heating.

18. The apparatus according to claim 10, wherein said equalizing means (45) is provided on a ladle rotary tower (53).

19. The apparatus according to claim 10, wherein said equalizing means (45) is arranged on a distribution trough (54).

20. The apparatus according to claim 10, wherein said second transfer means (40) is arranged within the housing (51) of a vacuum unit.

* * * * *